US010269294B2

(12) United States Patent
Kwak

(10) Patent No.: US 10,269,294 B2
(45) Date of Patent: Apr. 23, 2019

(54) ORGANIC LIGHT EMITTING DIODE DISPLAY DEVICE AND METHOD FOR DRIVING THE SAME

(71) Applicant: LG DISPLAY CO., LTD., Seoul (KR)

(72) Inventor: Sanghyeon Kwak, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 215 days.

(21) Appl. No.: 13/959,363

(22) Filed: Aug. 5, 2013

(65) Prior Publication Data

US 2014/0176523 A1 Jun. 26, 2014

(30) Foreign Application Priority Data

Dec. 24, 2012 (KR) ..... 10-2012-0152218

(51) Int. Cl.
*G09G 3/3233* (2016.01)

(52) U.S. Cl.
CPC ... *G09G 3/3233* (2013.01); *G09G 2300/0819* (2013.01); *G09G 2300/0852* (2013.01); *G09G 2300/0861* (2013.01); *G09G 2320/043* (2013.01)

(58) Field of Classification Search
CPC combination set(s) only.
See application file for complete search history.

(56) References Cited

U.S. PATENT DOCUMENTS 7,847,762 B2 * 12/2010 Iida ..... G09G 3/3233 315/169.3
2004/0257355 A1 12/2004 Naugler
2008/0198104 A1 8/2008 Yamashita et al.
2008/0316150 A1 12/2008 Lee et al.
2009/0309818 A1 12/2009 Kim
2010/0134388 A1 6/2010 Maekawa et al.
2010/0214273 A1 8/2010 Shirouzu et al.
2010/0253706 A1 10/2010 Shirouzu
2011/0102403 A1 * 5/2011 Kim ..... G09G 3/3233 345/211

(Continued)

FOREIGN PATENT DOCUMENTS

CA 2 536 398 A1 8/2007
CN 101329836 A 12/2008

(Continued)

*Primary Examiner* — William Boddie
*Assistant Examiner* — Alecia D English
(74) *Attorney, Agent, or Firm* — Birch, Stewart, Kolasch & Birch, LLP

(57) ABSTRACT

Discussed is an OLED display device. The OLED display device includes a first transistor, a driving transistor, a first capacitor, a second transistor, an OLED, and a third transistor. The first transistor supplies a data voltage or a reference voltage to a first node according to a scan signal. A gate of the driving transistor is connected to the first node, a source of the driving transistor is connected to a second node, and a drain of the driving transistor is connected to a fourth node. The first capacitor is connected between the first and second nodes. The second transistor supplies a high-level source voltage to the second node. The OLED emits light with a difference voltage between voltages of the first and second nodes. The third transistor connects the fourth node to a fifth node according to a second emission control signal.

13 Claims, 10 Drawing Sheets

(56) References Cited

U.S. PATENT DOCUMENTS

| | | | | |
|---|---|---|---|---|
| 2012/0169704 | A1 | 7/2012 | Chung | |
| 2013/0127818 | A1 | 5/2013 | Tsai et al. | |
| 2013/0135280 | A1* | 5/2013 | Iida | G09G 3/3233 345/211 |
| 2013/0169611 | A1 | 7/2013 | Chang et al. | |
| 2014/0084805 | A1* | 3/2014 | Kim | G09G 3/2048 315/228 |

FOREIGN PATENT DOCUMENTS

| | | | |
|---|---|---|---|
| CN | 101449311 | A | 6/2009 |
| CN | 101615379 | A | 12/2009 |
| CN | 101960509 | A | 1/2011 |
| CN | 102436793 | A | 5/2012 |
| JP | 2009-258397 | A | 11/2009 |
| JP | 2010-145579 | A | 7/2010 |
| JP | 2012-108192 | A | 6/2012 |

* cited by examiner

ORGANIC LIGHT EMITTING DIODE DISPLAY DEVICE AND METHOD FOR DRIVING THE SAME

CROSS-REFERENCE TO RELATED APPLICATIONS

This application claims the priority benefit of the Korean Patent Application No. 10-2012-0152218 filed on Dec. 24, 2012, which is hereby incorporated by reference as if fully set forth herein.

BACKGROUND

Field of the Invention

The present invention relates to a display device, and more particularly, to an organic light emitting diode (OLED) display device and a method of driving the same.

Discussion of the Related Art

With the advancement of information-oriented society, various requirements for display field are increasing, and thus, research is being done on various flat panel display devices that are thin and light, and have low power consumption. For example, the flat panel display devices are categorized into liquid crystal display (LCD) devices, plasma display panel (PDP) devices, OLED display devices, etc.

Especially, OLED display devices that are being actively studied recently apply data voltage (Vdata) having various levels to respective pixels to display different grayscale levels, thereby realizing an image.

To this end, each of a plurality of pixels includes one or more capacitors, an OLED, and a driving transistor that are current control elements. Especially, a current flowing in the OLED is controlled by the driving transistor, and the threshold voltage deviation of the driving transistor and the amount of a current flowing in the OLED are changed by various parameters, causing the luminance non-uniformity of a screen.

However, the threshold voltage deviation of the driving transistor occurs because the characteristic of the driving transistor is changed according to the manufacturing process variable of the driving transistor. To overcome this limitation, each pixel generally includes a compensation circuit that includes a plurality of transistors and capacitors for compensating for the threshold voltage deviation.

Recently, as consumers' requirements for high definition increase, a high-resolution OLED display device is demanded. To this end, it is necessary to integrate more pixels into an unit area for high resolution, and thus, it is required to reduce the numbers of transistors, capacitors, and lines included in the compensation circuit that compensates for a threshold voltage deviation.

SUMMARY

Accordingly, the present invention is directed to provide an organic light emitting diode (OLED) display device and a method of driving the same that substantially obviate one or more problems due to limitations and disadvantages of the related art.

An aspect of the present invention is directed to provide an OLED display device that can compensate for a threshold voltage deviation and a high-level source voltage deviation and is suitable for a large area, and a method of driving the same.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an OLED display device including: a first transistor supplying a data voltage or a reference voltage to a first node according to a scan signal; a driving transistor, a gate of the driving transistor being connected to the first node, a source of the driving transistor being connected to a second node, and a drain of the driving transistor being connected to a fourth node; a first capacitor connected between the first and second nodes, and storing a threshold voltage of the driving transistor; a second transistor supplying a high-level source voltage, applied to a third node, to the second node according to a first emission control signal; an OLED emitting light with a difference voltage between voltages of the first and second nodes; and a third transistor connecting the fourth node to a fifth node according to a second emission control signal, the fifth node being an anode of the OLED.

In another aspect of the present invention, there is provided a method of driving an OLED display device, which includes first to third transistors, a driving transistor, first and second capacitors, and an OLED, including: initializing a voltage of a first node to a reference voltage according to a scan signal applied to the first transistor, when the first to third transistors are turned on, the first node being a gate of the driving transistor; storing a threshold voltage of the driving transistor in the first capacitor connected to a second node that is a source of the driving transistor, when the first and third transistors are turned on and the second transistor is turned off, one end of the first capacitor being connected to the first node; supplying the data voltage to the first node, when the first transistor is turned on and the second and third transistors are turned off; and emitting, by the OLED, light with the data voltage and the reference voltage when the first transistor is turned off and the second and third transistors are turned on.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
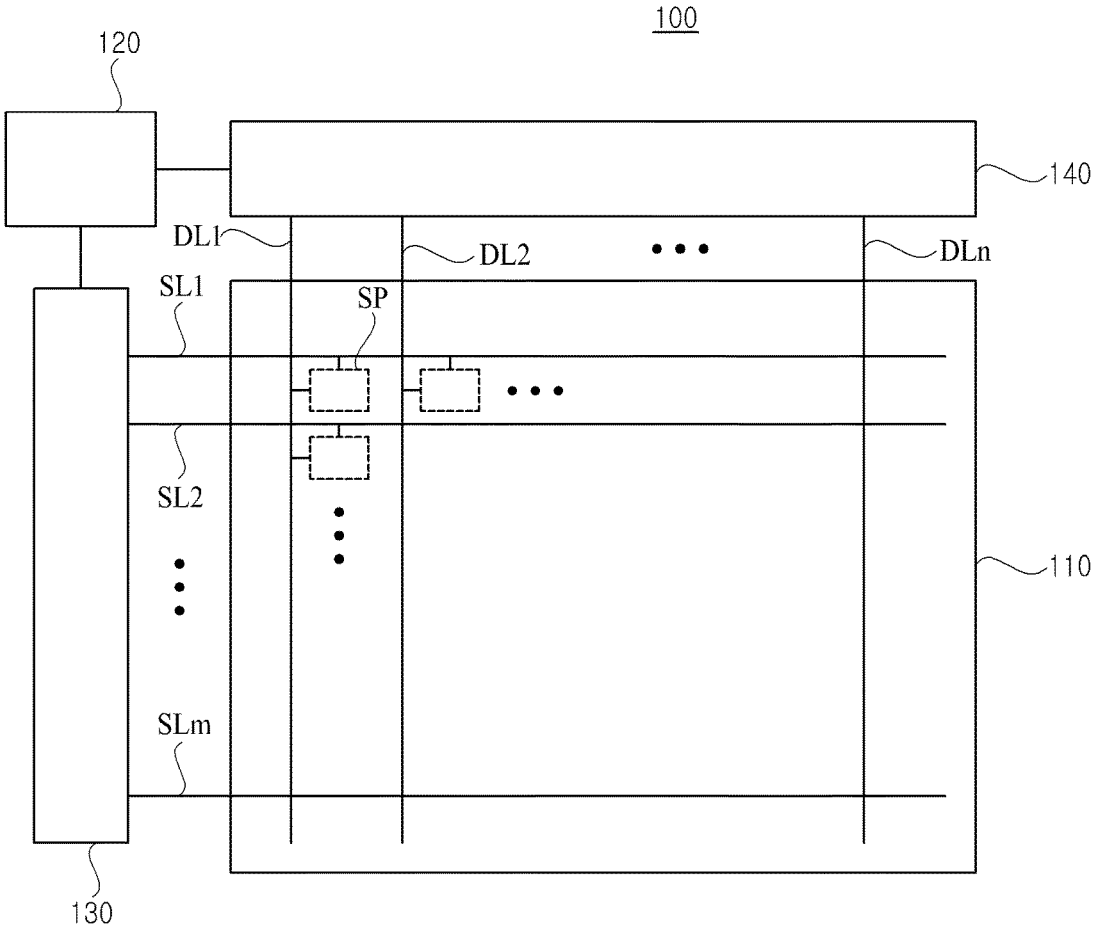
FIG. 1 is a diagram schematically illustrating a configuration of an OLED display device according to embodiments of the present invention.

FIG. 1 is a diagram schematically illustrating a configuration of an OLED display device according to embodiments of the present invention.

As illustrated in FIG. 1, an OLED display device 100 according to embodiments of the present invention includes a panel 110, a timing controller 120, a scan driver 130, and a data driver 140.

The panel 110 includes a plurality of sub-pixels SP that are arranged in a matrix type. The sub-pixels SP included in the panel 110 emit light according to respective scan signals (which are supplied through a plurality of scan lines SL1 to SLm from the scan driver 130) and respective data signals that are supplied through a plurality of data lines DL1 to DLn from the data driver 140. Also, the emission of the sub-pixels SP may be controlled by the scan signal, data signals, a plurality of first emission control signals supplied from the scan driver 130 through a plurality of first emission control lines (not shown), and a plurality of second emission controls signal supplied from the scan driver 130 through a plurality of second emission control lines (not shown).

To this end, one sub-pixel includes an OLED, and a plurality of transistors and capacitors for driving the OLED. The detailed configuration of each of the sub-pixels SP will be described in detail with reference to FIG. 2.

The timing controller 120 receives a vertical sync signal Vsync, a horizontal sync signal Hsync, a data enable signal DE, a clock signal CLK, and video signals from the outside. Also, the timing controller 120 aligns external input video signals to digital image data RGB in units of a frame.

For example, the timing controller 120 controls the operational timing of each of the scan driver 130 and the data driver 140 with a timing signal that includes the vertical sync signal Vsync, the horizontal sync signal Hsync, the data enable signal DE, and the clock signal CLK.

To this end, the timing controller 120 generates a gate control signal GCS for controlling the operational timing of the scan driver 130 and a data control signal DCS for controlling the operational timing of the data driver 140.

The scan driver 130 generates a scan signal "Scan" that enables the operations of transistors included in each of the sub-pixels SP included in the panel 110, according to the gate control signal GCS supplied from the timing controller 120, and supplies the scan signal "Scan" to the panel 110 through the scan lines SL. Also, the scan driver 130 generates the first and second emission control signals Em and H as a type of scan signal, and supplies the first and second emission control signals Em and H to the panel 100 through the respective first and second emission control lines (not shown). Hereinafter, a scan signal applied through an nth scan line of the scan lines is assumed as a scan signal Scan[n].

The data driver 140 generates data signals with the digital image data RGB and the data control signal DCS that are supplied from the timing controller 120, and supplies the generated data signals to the panel 110 through the respective data lines DL.

Hereinafter, the detailed configuration of each sub-pixel will be described in detail with reference to FIGS. 1 and 2.

Figure 2:
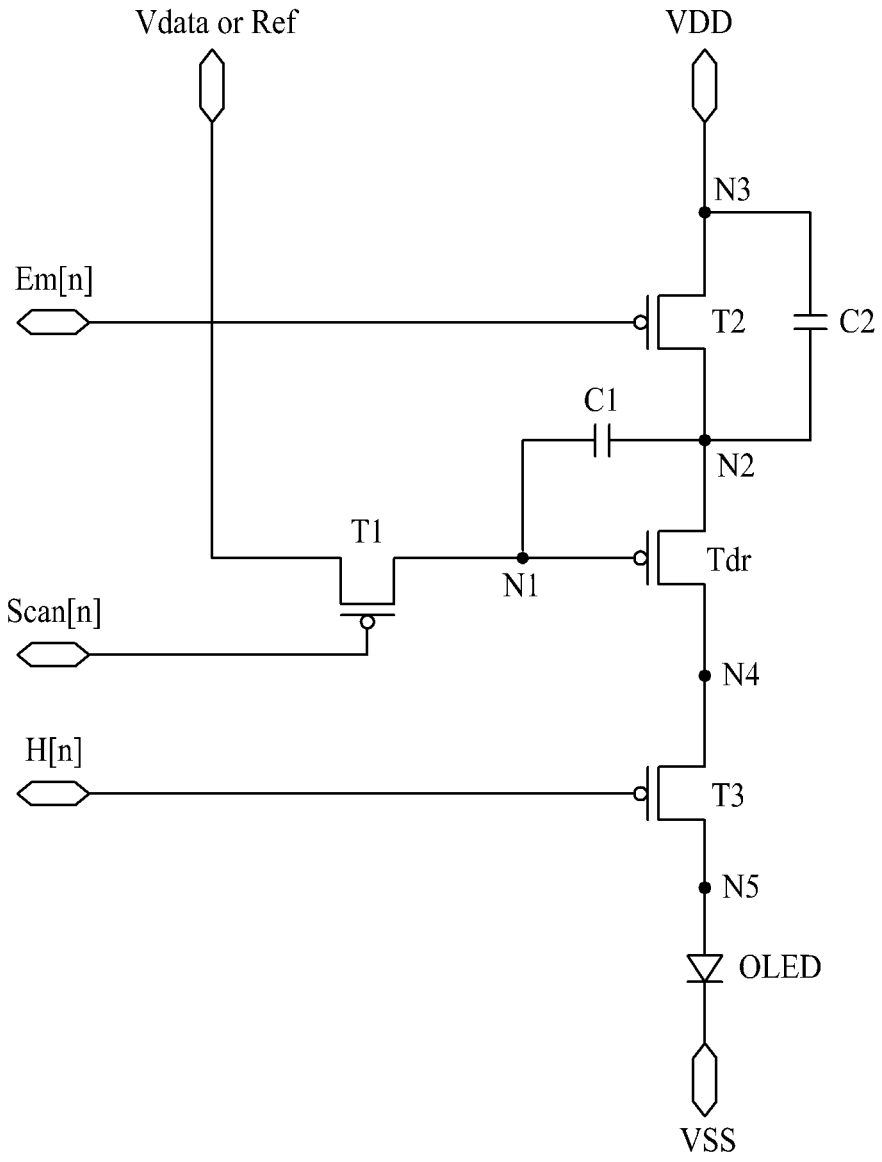
FIG. 2 is a diagram schematically illustrating an equivalent circuit of a sub-pixel of FIG. 1.

FIG. 2 is a diagram schematically illustrating an equivalent circuit of a sub-pixel of FIG. 1.

As illustrated in FIG. 2, each sub-pixel SP may include first to third transistors T1 to T3, a driving transistor Tdr, first and second capacitors C1 and C2, and an organic light emitting diode (OLED).

The first to third transistors T1 to T3 and the driving transistor Tdr, as illustrated in FIG. 2, are PMOS transistors, but are not limited thereto. As another example, an NMOS transistor may be applied thereto, in which case a voltage for turning on the PMOS transistor has a polarity opposite to that of a voltage for turning on the NMOS transistor.

First, a data voltage Vdata or a reference voltage Ref is applied to a source of the first transistor T1, the scan signal Scan[n] is applied to a gate of the first transistor T1, and a drain of the first transistor T1 is connected to a first node N1 which is a gate of the driving transistor Tdr.

For example, the data voltage Vdata or the reference voltage Ref may be applied to the source of the first transistor T1 through a data line DL, and an operation of the first transistor T1 may be controlled according to the scan signal Scan[n] supplied through a scan line SL.

Therefore, the first transistor T may be turned on according to the scan signal Scan[n], and supply the data voltage Vdata or the reference voltage Ref to the first node N1.

Here, the reference voltage Ref may be a direct current (DC) voltage having a constant level, and a plurality of the data voltages Vdata may be different successive voltages which are applied at three horizontal periods (3H). For example, when an n−1st data voltage Vdata[n−1] is applied to the source of the first transistor T1 during one horizontal period (1H), the reference voltage Ref may be applied to the source of the first transistor T1 during the next two horizontal periods (2H), and then, an nth data voltage Vdata[n] may be applied to the source of the first transistor T1 during the next one horizontal period (1H), and in succession, successive data voltages may be continuously applied to the source of the first transistor T1 at three horizontal periods (3H).

When the reference voltage Ref is applied to the first node N1, the reference voltage Ref may initialize the first node N1, which is the gate of the driving transistor Tdr, to the reference voltage Ref.

A high-level source voltage VDD may be applied to a third node N3 that is a source of the second transistor T2, a first emission control signal Em[n] may be applied to a gate of the second transistor T2, and a drain of the second transistor T2 may be connected to a second node N2 that is a source of the driving transistor Tdr.

For example, when the high-level source voltage VDD is applied to the third node N3 and the second transistor T2 is turned on according to the first emission control signal Em[n] supplied through a first emission control line, the third node N3 may be connected to the second node N2, and thus, the high-level source voltage VDD may be applied to the second node N2.

The first capacitor C1 may be connected between the first and second nodes N1 and N2.

For example, the first capacitor C1 may sense a threshold voltage "Vth" of the driving transistor Tdr, and specifically, the first capacitor C1 may store the threshold voltage of the driving transistor Tdr.

The second capacitor C2 may be connected between the second node N2 and the third node N3 receiving the high-level source voltage VDD.

For example, when the second transistor T2 is turned off by the first emission control signal Em[n] and thus the third node N3 is disconnected from the second node N2, the high-level source voltage VDD may be continuously applied to one end of the second capacitor C2.

The gate of the driving transistor Tdr may be connected to the first node N1, the source of the driving transistor Tdr may be connected to the second node N2, and a drain of the driving transistor Tdr may be connected to a fourth node N4.

The amount of a current flowing in the below-described organic light emitting diode (OLED) may be decided by the sum "Vsg+Vth" of a source-gate voltage "Vsg" of the driving transistor Tdr and the threshold voltage "Vth" of the driving transistor Tdr, and finally decided by a compensation circuit with the data voltage Vdata and the reference voltage Ref.

Therefore, since the amount of a current flowing in the OLED is proportional to the level of the data voltage Vdata, the OLED display device according to embodiments of the present invention applies various levels of data voltages Vdata to respective sub-pixels SP to realize different gray scales, thereby displaying an image.

A second emission control signal H[n] may be applied to a gate of the third transistor T3, a source of the third transistor T3 may be connected to the fourth node N4 that is the drain of the driving transistor Tdr, and a drain of the third transistor T3 may be connected to a fifth node N5 that is an anode of the OLED.

For example, when the third transistor T3 is turned on according to the second emission control signal H[n] supplied through a second emission control line, the fourth node N4 may be connected to the fifth node N5, and thus, the OLED may emit light.

For example, when the third transistor T3 is turned off by the second emission control signal H[n], the OLED may be turned off, and, when the third transistor T3 is turned on, the emission of the OLED may be controlled by the scan signal Scan[n] and the first emission control signal Em[n].

In this example, the second emission control signal H[n] may be a separate emission control signal different from the first emission control signal Em[n], but, when the first emission control signal is an nth first emission control signal Em[n], the second emission control signal H[n] may be an n+1st first emission control signal Em[n+1].

The anode of the OLED may be connected to the fifth node N5, and a low-level source voltage VSS may be applied to a cathode of the OLED.

Hereinafter, the operation of each sub-pixel included in the OLED display device according to embodiments of the present invention will be described in detail with reference to FIGS. 3 and 5A to 5D.

Figure 3:
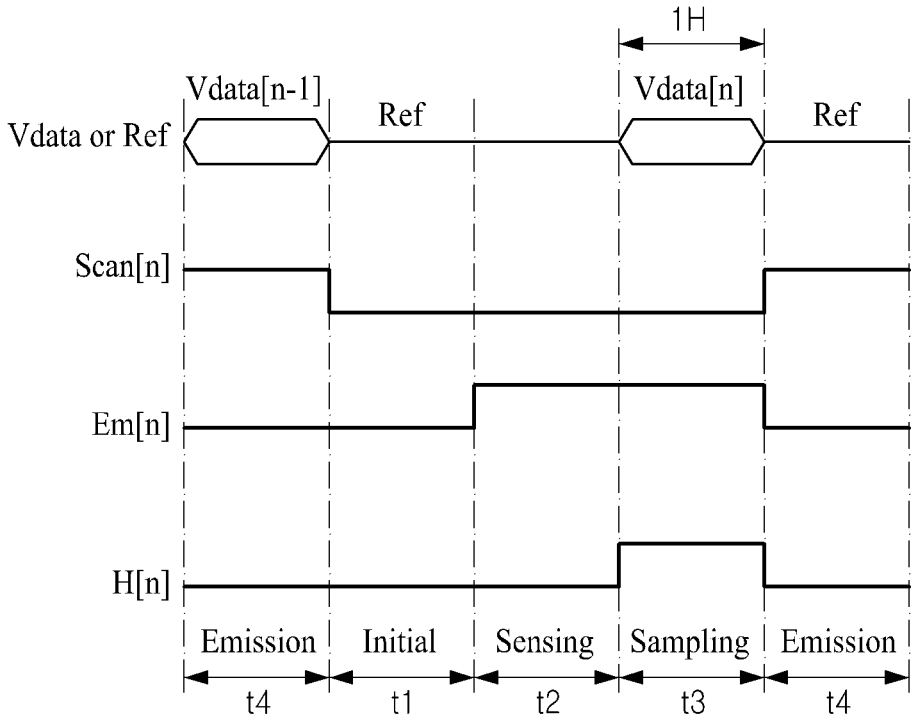
FIG. 3 is a timing chart according to an embodiment of each of control signals supplied to the equivalent circuit of FIG. 2.

FIG. 3 is a timing chart according to an embodiment of each of control signals supplied to the equivalent circuit of FIG. 2. FIGS. 5A to 5D are diagrams for describing a method of driving an OLED display device according to embodiments of the present invention.

As shown in FIG. 3, the OLED display device according to embodiments of the present invention may fall into an initial period t1, a sensing period t2, a sampling period t3, and an emission period t4, and operate during the respective periods t1 to t4. Each of the initial period t1, sensing period t2, and sampling period t3 may be one horizontal period (1H).

Hereinafter, as illustrated in FIGS. 5A to 5D, the value of a high-level source voltage applied to the third node N3 is changed by IR drop caused by the resistance of a line through which the high-level source voltage is transferred, during each of the periods t1 to t4, and thus, it is assumed that high-level source voltages VDD1 to VDD4 applied during the respective periods t1 to t4 have different values.

During the initial period t1, as shown in FIG. 3, the scan signal Scan[n] having a low level and the first and second emission control signals Em[n] and H[n] may be applied to a sub-pixel, and the reference voltage Ref may be applied to the source of the first transistor T1 through the data line.

Figure 5A:
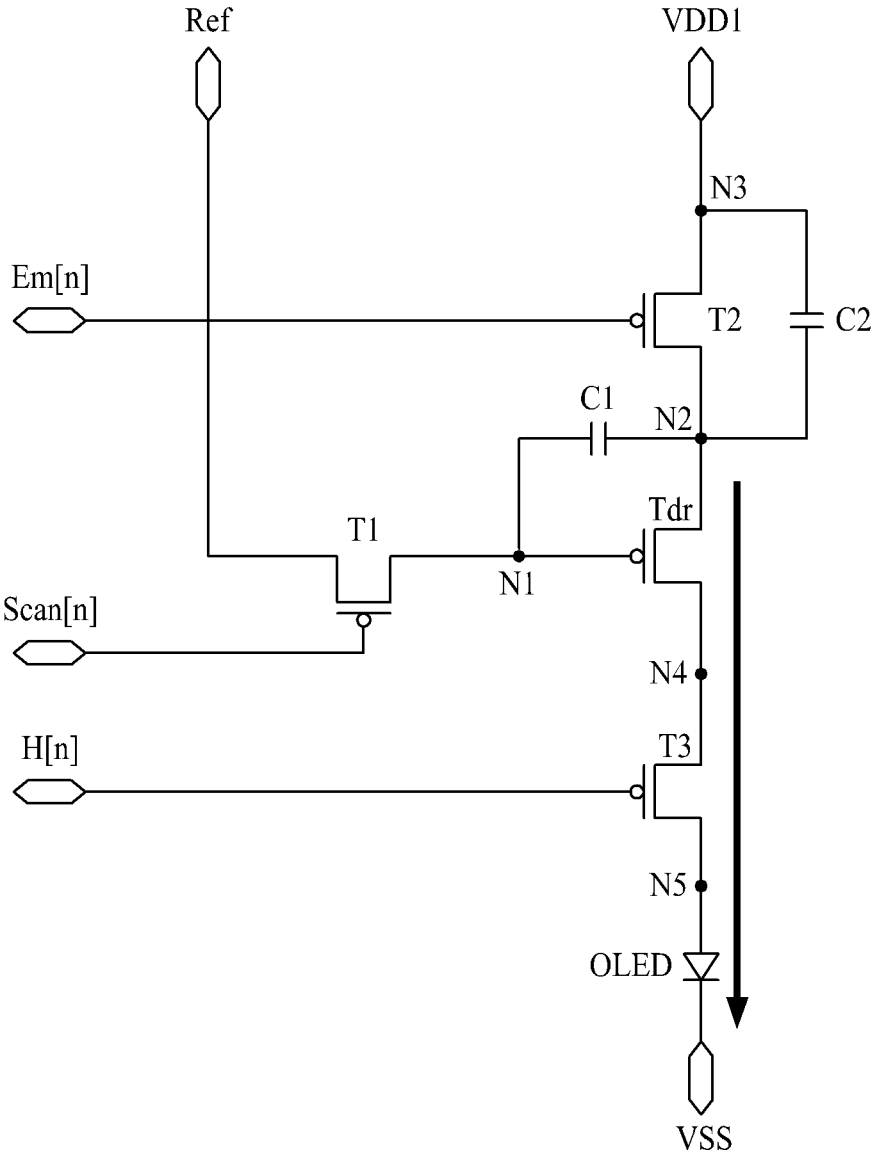
FIGS. 5A to 5D are diagrams for describing a method of driving an OLED display device according to embodiments of the present invention.

Therefore, as illustrated in FIG. 5A, the first transistor T1 may be turned on by the scan signal Scan[n] having a low level, the second transistor T2 may be turned on by the first emission control signal Em[n] having a low level, and the third transistor T3 may be turned on by the second emission control signal H[n] having a low level.

Moreover, since the first transistor T1 is turned on, the reference voltage Ref may be supplied to the first node N1 that is the source of the first transistor T1 through the data line, and the voltage of the first node N1 may be initialized to the reference voltage Ref. Furthermore, since the second transistor T2 is turned on, the high-level source voltage VDD1 applied to the third node N3 that is the source of the second transistor T2 may be supplied to the second node N2 that is the source of the driving transistor Tdr. Also, as the third transistor T3 is turned on, the fourth node N4 may be connected to the fifth node N5.

For example, during the initial period t1, as the fourth node N4 is connected to the fifth node N5, a current flows in the OLED, but, since the initial period t1 is a very short period equal to one horizontal period (1H), light emitted from the OLED may be invisible to a viewer's eyes. The voltage of the first node N1 that is the gate of the driving transistor Tdr may merely be initialized to the reference voltage Ref.

As a result, during the initial period t1, as the third transistor T3 is turned on, a current may not flow in the OLED, but, since the first transistor T1 is turned on, the voltage of the first node N1 that is the gate of the driving transistor Tdr may be initialized to the reference voltage Ref that is a constant DC voltage.

Subsequently, during the sensing period t2, as shown in FIG. 3, the scan signal Scan[n] and second emission control signal H[n] having a low level and the first emission control signal Em[n] having a high level may be applied to the sub-pixel.

Figure 5B:
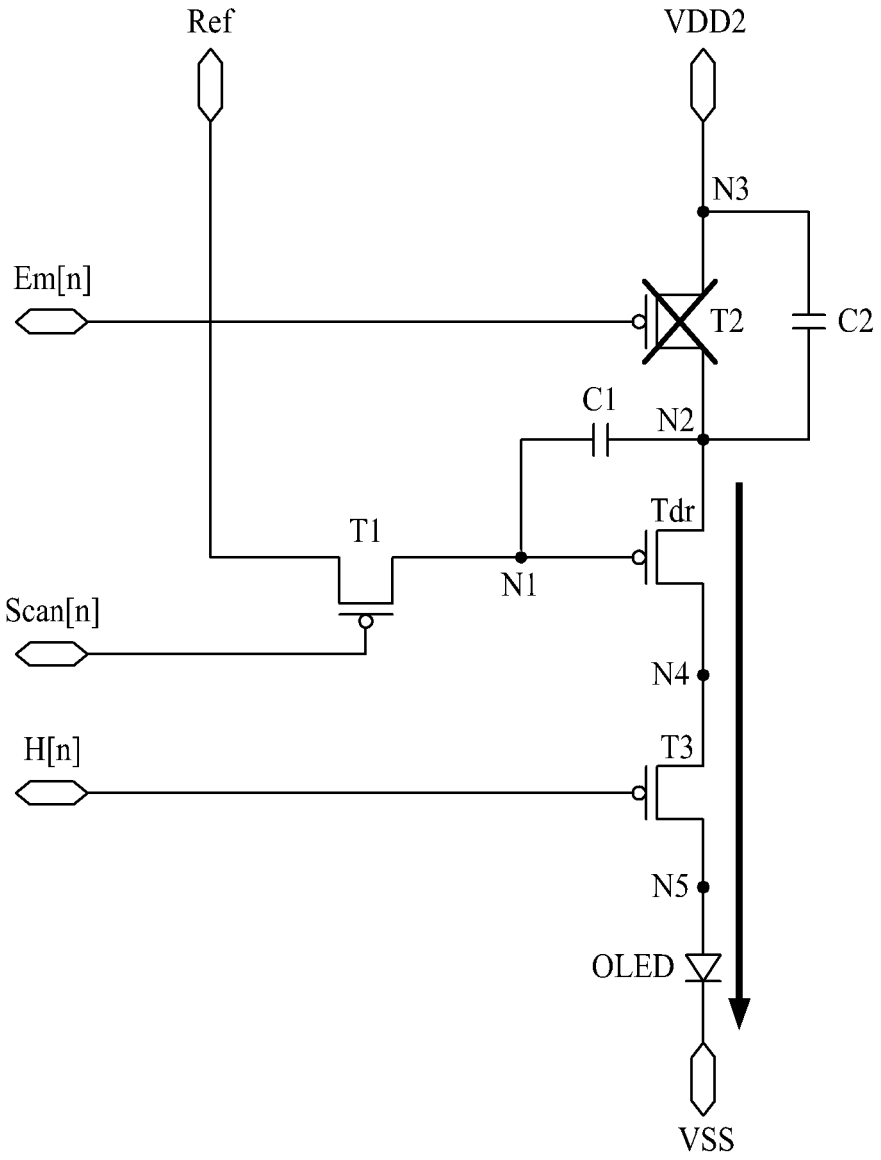

Therefore, as illustrated in FIG. 5B, the first transistor T1 may be turned on by the scan signal Scan[n] having a low level, the second transistor T2 may be turned off by the first emission control signal Em[n] having a high level, the third transistor T3 may be turned on by the second emission control signal H[n] having a low level, and the reference voltage Ref may be applied to the source of the first transistor T1 through the data line.

Moreover, as the first transistor T1 maintains a turn-on state, the reference voltage Ref may be supplied to the first node N1 that is the source of the first transistor T1 through the data line, and the voltage of the first node N1 may maintain the reference voltage Ref. Furthermore, since the second transistor T2 is turned off, a direct connection between the second and third nodes N2 and N3 may be broken, but the high-level source voltage VDD2 may be supplied to the third node N3 that is one end of the second capacitor C2. Also, as the third transistor T3 maintains a turn-on state, a connection between the fourth and fifth nodes N4 and N5 may be maintained.

For example, during the sensing period t2, although the voltage of the first node N1 maintains the reference voltage Ref, as the second transistor T2 is turned off, the direct connection between the second and third nodes N2 and N3 may be broken, and electric charges which are stored in the first and second capacitors C1 and C2 during the initial period t1 may be discharged, whereby the voltage of the second node N2 is more reduced to less than the high-level source voltage VDD1 that is the voltage of the second node N2 during the initial period t1.

As a result, during the sensing period t2, the voltage of the second node N2 may be reduced to less than the high-level source voltage VDD1, and then reduced up to a voltage "Ref+|Vth|" greater than the reference voltage Ref (which is the voltage of the first node N1 that is the gate of the driving transistor Tdr) by an absolute threshold voltage "|Vth|" of the driving transistor Tdr. Therefore, at a time when the sensing period t2 is completed, the threshold voltage "Vth" of the driving transistor Tdr may be stored in the first capacitor C1.

This reason is that since the driving transistor Tdr has a source-follower-type connection, the voltage of the second node N2 that is the source of the driving transistor Tdr is reduced, and then up to the voltage "Ref+|Vth|" greater than the reference voltage Ref (which is the voltage of the gate of the driving transistor Tdr which is a voltage until the driving transistor Tdr is turned off) by the absolute threshold voltage "|Vth|" of the driving transistor Tdr.

Therefore, during the sensing period t2, the first capacitor C1 may sense the threshold voltage "Vth" of the driving transistor Tdr.

Subsequently, during the sampling period t3, as shown in FIG. 3, the scan signal Scan[n] having a low level and the first and second emission control signals Em[n] and H[n] having a high level may be applied to the sub-pixel.

Figure 5C:
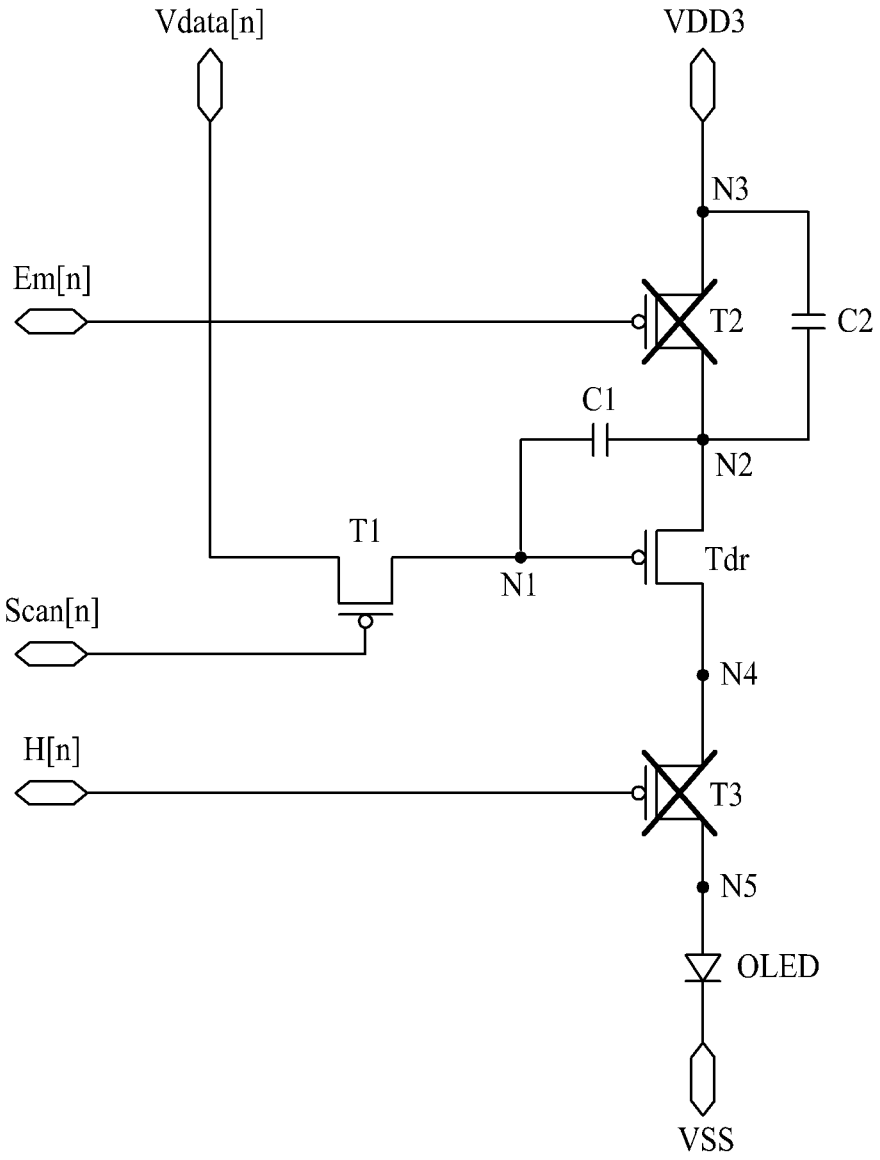

Therefore, as illustrated in FIG. 5C, the first transistor T1 may be turned on by the scan signal Scan[n] having a low level, the second and third transistors T2 and T3 may be turned off by the first and second emission control signals Em[n] and H[n] having a high level, and the data voltage Vdata may be applied to the source of the first transistor T1 through the data line.

Moreover, as the first transistor T1 is turned on, a data voltage Vdata[n] may be supplied to the first node N1 that is the source of the first transistor T1 through the data line. Furthermore, since the second transistor T2 maintains a turn-off state, the high-level source voltage VDD3 may be continuously supplied to the third node N3 that is one end of the second capacitor C2. Also, as the third transistor T3 is turned off, the fourth node N4 may be disconnected from the fifth node N5, and thus, the OLED may be turned off.

For example, during the sensing period t2, the reference voltage Ref may be supplied to the first node N1 that is one end of the first capacitor C1, and then, during the sampling period t3, as the data voltage Vdata[n] is supplied to the first node N1, the voltage of the second node N2 that is the other end of the first capacitor C1 may also be changed. However, since a voltage stored in the first capacitor C1 is maintained without any change and the first and second capacitors C1 and C2 are serially connected, the voltage of the second node N2 may be decided by a ratio of capacitances "c1" and "c2" of the first and second capacitors C1 and C2. Accordingly, the voltage of the second node N2 may be expressed as "Vdata[n]−[Ref+|Vth|+{c1/(c1+c2)}(Vdata[n]−Ref)]" with the voltage "Ref+|Vth|" of the second node N2, a change "Vdata[n]−Ref" in the voltage of the first node N1, and a capacitance ratio "c1/(c1+c2)" of the first and second capacitors C1 and C2. Therefore, a voltage "VC1" equal to a voltage "Vdata[n]−[Ref+|Vth|+{c1/(c1+c2)} (Vdata[n]−Ref)]" may be stored in the first capacitor C1. To provide an additional description, the voltage "VC1" stored in the first capacitor C1 may become a voltage "{c2/(c1+c2)} (Vdata [n]−Ref)−|Vth|".

Accordingly, since the capacitance ratio of the first and second capacitors C1 and C2 affects a current "Ioled" flowing in the below-described OLED, a case in which the current "Ioled" flowing in the OLED is peaked needs a voltage greater than a case in which the capacitance ratio does not affect the current "Ioled", and thus, the resolving power of the current "Ioled" flowing in the OLED due to a data voltage can be enhanced.

As a result, during the sampling period t3, the first capacitor C1 may sample a data voltage which is required for the OLED to emit light during the emission period t4.

Each OLED included in the OLED display device according to embodiments of the present invention starts to emit light immediately after sampling of a corresponding scan line is completed in each frame.

In other words, an operation in which all the scan lines are scanned and immediately all OLEDs emit light will be described below in more detail with reference to FIG. 4.

Figure 4:
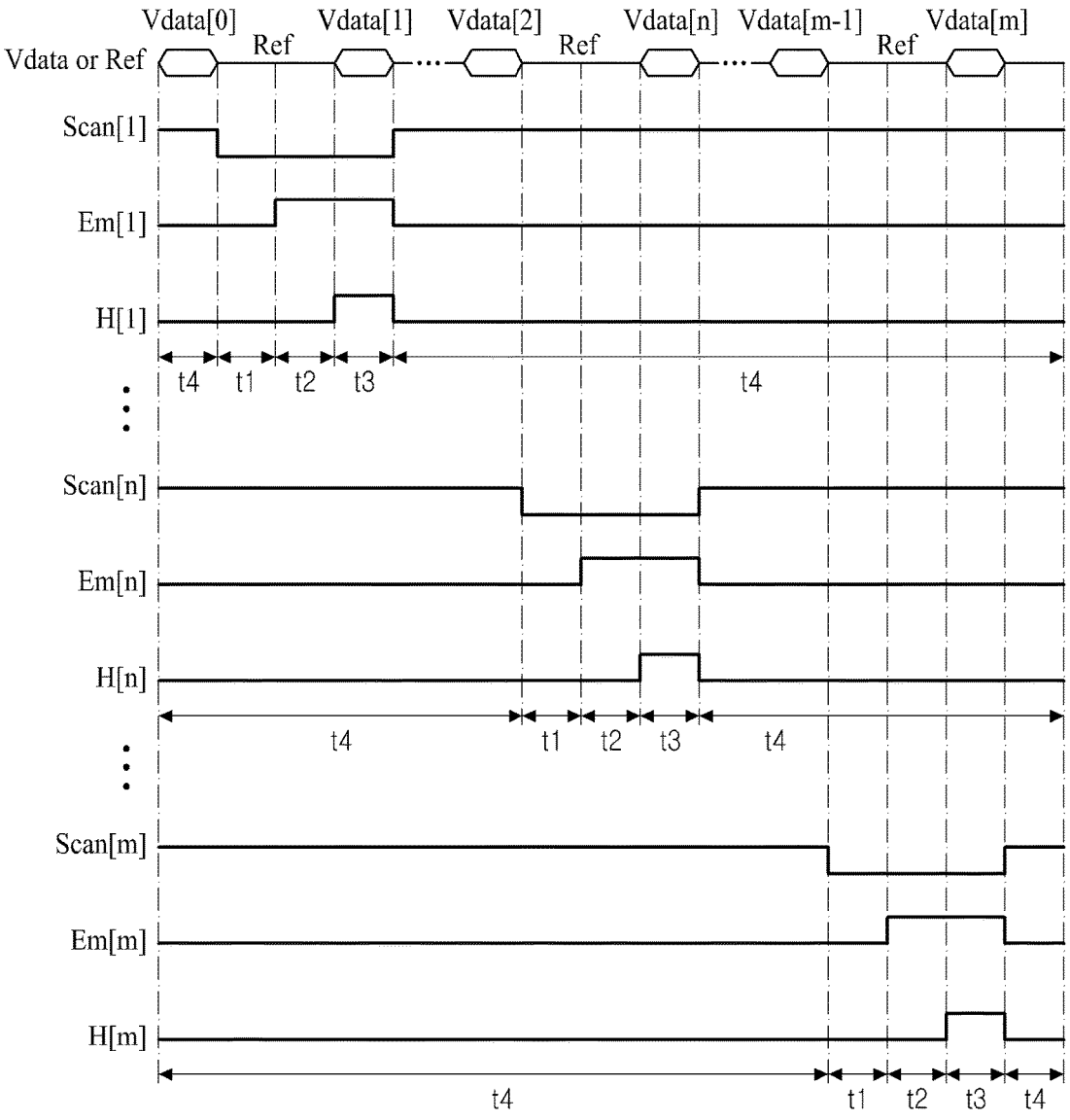
FIG. 4 is a timing chart showing in detail the timing chart of FIG. 3.

FIG. 4 is a timing chart showing in detail the timing chart of FIG. 3. In the OLED display device according to embodiments of the present invention, when it is assumed that the number of scan lines is m number, scan signals Scan[1], Scan[n] and Scan[m] are respectively applied to a first scan line, an nth scan line, and an mth scan line, and first to mth data voltages Vdata[1] to Vdata[m] are applied to one data line intersecting each scan line.

Here, a scan period for which a plurality of data voltages are applied to respective sub-pixels may include the initial period t1, the sensing period t2, the sampling period t3, and the emission period t4 for each scan line.

Thus, the OLED starts to emit light immediately after sampling of a corresponding data voltage is completed for each scan line.

During the emission period t4, as shown in FIG. 3, the scan signal Scan[n] having a high level and the first and second emission control signals Em[n] and H[n] having a low level may be applied to the sub-pixel.

Figure 5D:
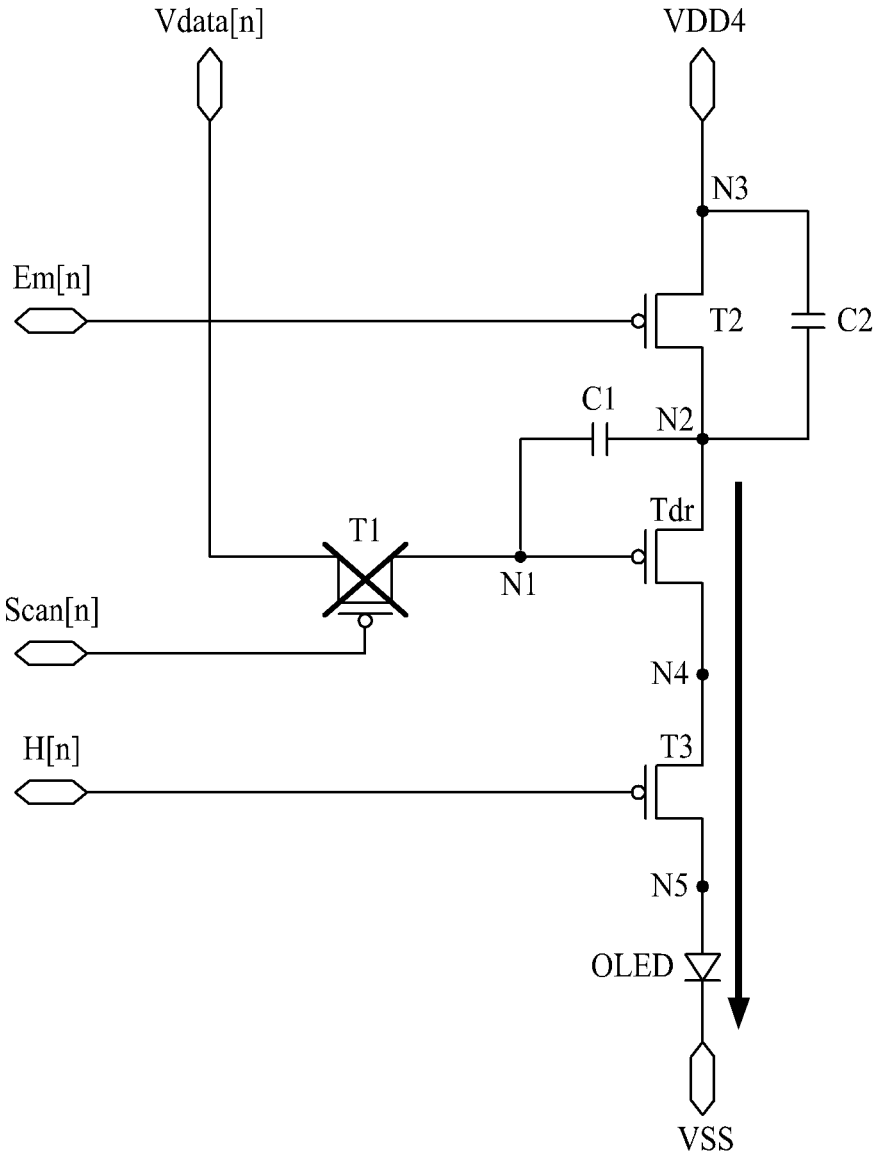

Therefore, as illustrated in FIG. 5D, the first transistor T1 may be turned off by the scan signal Scan[n] having a high level, and the second and third transistors T2 and T3 may be respectively turned on by the first and second emission control signals Em[n] and H[n] having a low level, and the reference voltage Ref may be applied to the source of the first transistor T1 through the data line. However, since the first transistor T1 is turned off by the scan signal Scan[n] having a high level, the voltage of the first node N1 may not be changed. Also, since the second transistor T2 is turned on, as the high-level source voltage VDD4 is directly supplied to the third node N3 and the third transistor T3 is turned on, the fourth node N4 may be connected to the fifth node N5, and thus, the OLED may start to emit light.

Accordingly, the current Ioled flowing in the OLED may be decided with a current flowing in the driving transistor Tdr, and the current flowing in the driving transistor Tdr may be decided with the gate-source voltage (Vgs) of the driving transistor Tdr and the threshold voltage (Vth) of the driving transistor Tdr. The current Ioled may be defined as expressed in Equation (1). Also, the voltage of the first node N1 that is the gate of the driving transistor Tdr may become a voltage "VDD4+{c2/(c1+c2)} (Vdata[n]−Ref)−|Vth|" due to the voltage "VC1" which is stored in the first capacitor C1 during the sampling period t3.

$$
\begin{aligned}
Ioled &= K \times (Vgs - Vth)^2 \qquad (1)\\
&= K \times (Vsg + Vth)^2\\
&= K \times \left[\begin{array}{c} VDD - VDD4 - \\ \{c2/(c1+c2)\}(V\mathrm{data}[n] - Ref) + \\ |Vth| + Vth \end{array}\right]^2\\
&= K \times [\{c2/(c1+c2)\}(V\mathrm{data}[n] - Ref) + |Vth| - |Vth|]^2\\
&= K \times [\{c2/(c1+c2)\}(V\mathrm{data}[n] - Ref)]^2
\end{aligned}
$$

where K denotes a proportional constant that is decided by the structure and physical properties of the driving transistor Tdr, and may be decided with the mobility of the driving transistor Tdr and the ratio "W/L" of the channel width "W" and length "L" of the driving transistor Tdr. Also, when the transistors included in the OLED are PMOS transistors, the threshold voltage of each of the transistors has a negative value. The threshold voltage "Vth" of the driving transistor Tdr does not always have a constant value, and the deviation of the threshold voltage "Vth" occurs according to the operational state of the driving transistor Tdr.

Referring to Equation (1), in the OLED display device according to embodiments of the present invention, the current Ioled flowing in the OLED is not be affected by the threshold voltage "Vth" of the driving transistor Tdr during the emission period t4, and may merely be decided with a difference voltage between the data voltage Vdata and the reference voltage Ref. The OLED display device according to embodiments of the present invention is not affected by a high-level source voltage which is changed by IR drop caused by the resistance of a line through which the high-level source voltage is transferred.

In FIG. 3, it has been described above that an operation of each of the first to third transistors T1 to T3 may be controlled by the control signals such as the scan signal Scan[n] and the first and second emission control signals Em[n] and H[n], and data voltages may be applied to the respective sub-pixels at three horizontal periods (3H). In another embodiment, however, the second emission control signal H[n] may be the n+1st first emission control signal Em[n+1] next to the nth first emission control signal Em[n], and data voltages may be applied to the respective sub-pixels at two horizontal periods (2H).

Hereinafter, control signals according to another embodiment of the present invention will be described with reference to FIG. 6.

Figure 6:
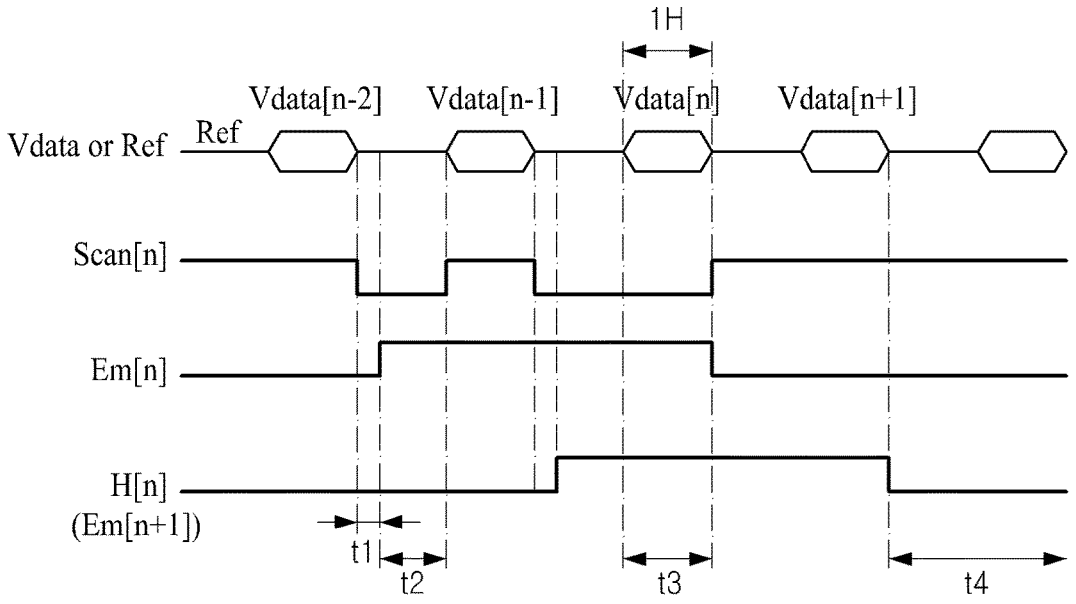
FIG. 6 is a timing chart according to another embodiment of each of control signals supplied to the equivalent circuit of FIG. 2.

FIG. 6 is a timing chart according to another embodiment of each of control signals supplied to the equivalent circuit of FIG. 2.

As shown in FIG. 6, it can be seen that a next data voltage is applied to a sub-pixel at two horizontal periods (2H) unlike the data voltage of FIG. 5, and moreover, the reference voltage Ref is applied to the sub-pixel at two horizontal periods (2H). Also, it can be seen that the second emission control signal "H[n]" is the n+1st first emission control signal "Em[n+1]".

As shown in FIG. 6, similarly to FIG. 5, the OLED display device according to embodiments of the present invention may fall into an initial period t1, a sensing period t2, a sampling period t3, and an emission period t4, and operate during the respective periods t1 to t4. Here, the sampling period t3 may be one horizontal period (1H), and the sum of the initial period t1 and the sensing period t2 may be one horizontal period (1H).

Accordingly, by compensating for the threshold voltage deviation caused by the operational state of the driving transistor and the high-level source voltage deviation caused by IR drop, the OLED display device according to the embodiments of the present invention can maintain a constant current flowing in each OLED, thus preventing the degradation of image quality.

Moreover, since the number of transistors and capacitors included in the compensation circuit is small, the OLED display device according to embodiments of the present invention can be suitable for a large area.

Figure 7:
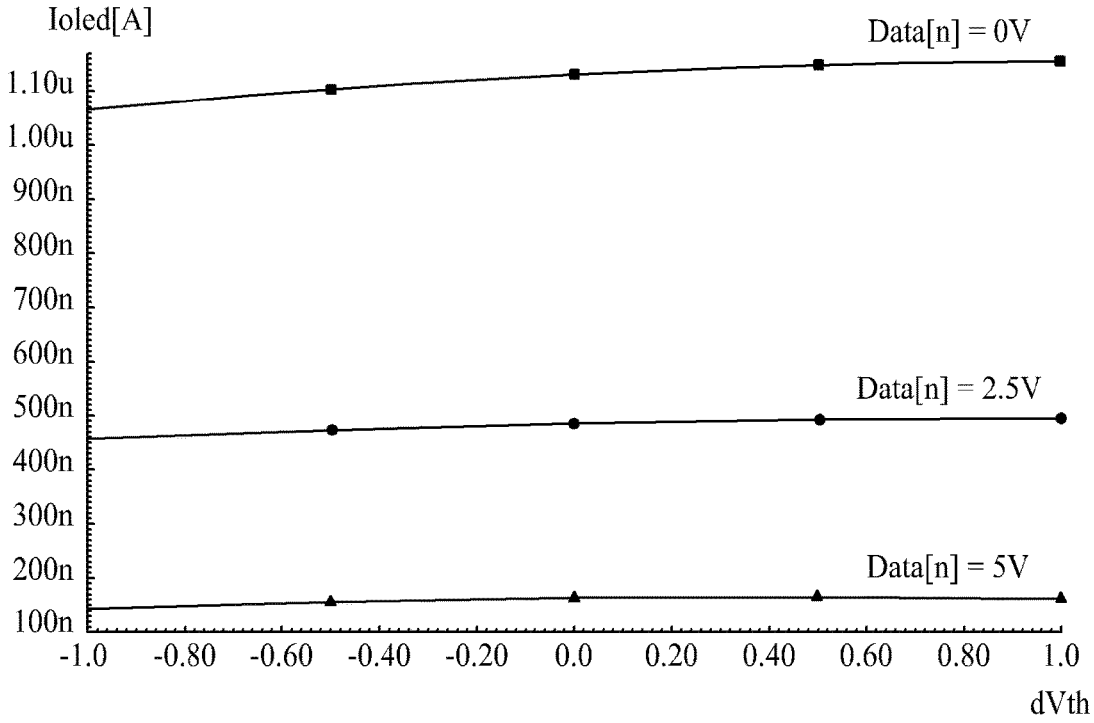
FIG. 7 is a diagram for describing a change in a current due to a threshold voltage deviation of the OLED display device according to embodiments of the present invention.

FIG. 7 is a diagram for describing a change in a current due to a threshold voltage deviation of the OLED display device according to embodiments of the present invention.

As show in FIG. 7, it can be seen that the level of the current Ioled flowing in the OLED is proportional to the data voltage Vdata, but the level of the current Ioled is not greatly changed according to a threshold voltage deviation "dVth" under the same data voltage Vdata.

According to the embodiments of the present invention, by compensating for the threshold voltage deviation caused by the operational state of the driving transistor and the high-level source voltage deviation caused by IR drop, a current flowing in each OLED can be maintained without any change, thus preventing the degradation of image quality.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode (OLED) display device, comprising:

a first transistor supplying a data voltage and a reference voltage to a first node according to a scan signal;

a driving transistor, a gate of the driving transistor being connected to the first node, a source of the driving transistor being connected to a second node, and a drain of the driving transistor being connected to a fourth node;

a first capacitor connected between the first and second nodes, and storing a threshold voltage of the driving transistor;

a second capacitor connected between the second node and a third node that is a source of a second transistor;

the second transistor supplying a high-level source voltage, applied to the third node, to the second node according to a first emission control signal provided to a gate of the second transistor;

an OLED emitting light with a difference voltage between the data voltage and the reference voltage; and a third transistor connecting the fourth node to a fifth node according to a second emission control signal, the fifth node being an anode of the OLED, wherein when the scan signal is an nth scan signal, the first emission control signal is an nth first emission control signal, and the second emission control signal is an (n+1)th first emission control signal, wherein the OLED starts to emit light immediately after the first transistor is turned off and the second and third transistors are turned on upon completion of sampling of the data voltage for each scan line, wherein a period between a first time on which applying an nth data voltage to a sub-pixel is started and a second time on which applying an (n+1)th data voltage to the sub-pixel is started is two horizontal periods, wherein a sampling period in which the data voltage is supplied to the first node is one horizontal period, and a sum of an initial period in which the voltage of the first node is initialized to the reference voltage and a sensing period in which the threshold voltage of the driving transistor is stored in the first capacitor is one horizontal period, and wherein the data voltage and the reference voltage are alternately applied to the first transistor by one horizontal period.

2. The OLED display device of claim 1, wherein, the first transistor is turned on by the scan signal which is applied thereto through a scan line, the second transistor is turned on by the first emission control signal which is applied thereto through a first emission control line, and the third transistor is turned on by the second emission control signal which is applied thereto through a second emission control line.

3. The OLED display device of claim 1, wherein when the first to third transistors are turned on, the reference voltage is supplied to the first node, the high-level source voltage is supplied to the second node, and the fourth node is connected to the fifth node, such that the voltage of the first node is initialized to the reference voltage.

4. The OLED display device of claim 3, wherein when the first and third transistors are turned on, and the second transistor is turned off, the reference voltage is supplied to the first node, the fourth node is connected to the fifth node, and the voltage of the second node is reduced to less than the high-level source voltage.

5. The OLED display device of claim 4, wherein the voltage of the second node is reduced up to a sum of the reference voltage and an absolute threshold voltage of the driving transistor.

6. The OLED display device of claim 4, wherein when the first transistor is turned on, and the second and third transistors are turned off, the data voltage is supplied to the first node.

7. The OLED display device of claim 6, wherein when the first transistor is turned off, and the second and third transistors are turned on, the OLED emits light.

8. A method of driving an organic light emitting diode (OLED) display device which includes first to third transistors, a driving transistor, first and second capacitors, and an OLED, the method comprising:

initializing a voltage of a first node to a reference voltage according to a scan signal applied to the first transistor, when the first to third transistors are turned on, the first node being a gate of the driving transistor;

storing a threshold voltage of the driving transistor in the first capacitor connected to a second node that is a source of the driving transistor, when the first and third transistors are turned on and the second transistor is turned off, one end of the first capacitor being connected to the first node;

supplying the data voltage to the first node, when the first transistor is turned on and the second and third transistors are turned off; and emitting, by the OLED, light with a difference voltage between the data voltage and the reference voltage when the first transistor is turned off and the second and third transistors are turned on, wherein the first transistor is turned on by the scan signal, the second transistor is turned on by a first emission control signal provided to a gate of the second transistor, and the third transistor is turned on by a second emission control signal, and wherein when the scan signal is an nth scan signal, the first emission control signal is an nth first emission control signal, and the second emission control signal is an (n+1)th first emission control signal, wherein the OLED starts to emit light immediately after the first transistor is turned off and the second and third transistors are turned on upon completion of sampling of the data voltage for each scan line, wherein a period between a first time on which applying an nth data voltage to a sub-pixel and a second time on which applying an (n+1)th data voltage to the sub-pixel is started is two horizontal periods, wherein a sampling period in which the data voltage is supplied to the first node is one horizontal period, and a sum of an initial period in which the voltage of the first node is initialized to the reference voltage and a sensing period in which the threshold voltage of the driving transistor is stored in the first capacitor is one horizontal period, and wherein the data voltage and the reference voltage are alternately applied to the first transistor by one horizontal period.

9. The method of claim 8, wherein the initializing of a voltage comprises:

supplying a high-level source voltage to the second node; and connecting a fourth node to a fifth node, the fourth node being a drain of the driving transistor, and the fifth node being an anode of the OLED.

10. The method of claim 8, wherein the storing of a threshold voltage comprises:

supplying the reference voltage to the first node; and reducing a voltage of the second node to a sum of the reference voltage and an absolute threshold voltage of the driving transistor.

11. The method of claim 8, wherein, a source of the second transistor is connected to a third node receiving a high-level source voltage, a drain of the second transistor is connected to the second node, and the second capacitor is connected between the second and third nodes.

12. The method of claim 8, wherein the supplying of the data voltage comprises disconnecting a fourth node from a fifth node, the fourth node being a drain of the driving transistor, and the fifth node being an anode of the OLED.

13. The method of claim 8, wherein, the scan signal is applied to a gate of the first transistor through a scan line.

* * * * *